US006742287B2

(12) United States Patent
DeKalb et al.

(10) Patent No.: US 6,742,287 B2
(45) Date of Patent: Jun. 1, 2004

(54) DIVE BOOT PURGE SYSTEM

(75) Inventors: Shawn W. DeKalb, San Diego, CA (US); Robbert Bruins, Oceanside, CA (US)

(73) Assignee: Aqua Lung America, Inc., Vista, CA (US)

( * ) Notice: Subject to any disclaimer, the term of this patent is extended or adjusted under 35 U.S.C. 154(b) by 100 days.

(21) Appl. No.: 10/091,623

(22) Filed: Mar. 5, 2002

(65) Prior Publication Data

US 2003/0167653 A1 Sep. 11, 2003

(51) Int. Cl.[7] ..... A43B 5/08; A43B 13/20; A43B 7/08; B63C 11/02; B63C 11/04

(52) U.S. Cl. ..... 36/8.1; 36/3 R; 36/3 B; 36/29; 405/186; 2/2.17

(58) Field of Search ..... 36/8.1, 3 R, 3 A, 36/3 B, 29, 28, 105; 2/2.15, 2.16, 2.17; 405/185, 186

(56) References Cited

U.S. PATENT DOCUMENTS

| | | | | | |
|---|---|---|---|---|---|
| 206,267 | A | * | 7/1878 | Schwarzwald | 36/3 B |
| 508,034 | A | * | 11/1893 | Moore | 36/3 B |
| 510,504 | A | * | 12/1893 | Foster | 36/3 B |
| 3,044,188 | A | * | 7/1962 | Evangelista | 36/3 B |
| 4,602,441 | A | * | 7/1986 | El Sakkaf | 36/3 R |
| 4,939,851 | A | * | 7/1990 | Miller | 36/3 B |
| 5,341,581 | A | * | 8/1994 | Huang | 36/3 B |
| 5,515,622 | A | * | 5/1996 | Lee | 36/3 R |
| 5,701,687 | A | * | 12/1997 | Schmidt et al. | 36/3 B |
| 5,953,834 | A | * | 9/1999 | Clodic | 35/3 R |
| 6,477,789 | B2 | * | 11/2002 | Cheng | 36/3 B |

FOREIGN PATENT DOCUMENTS

FR 2614510 * 11/1988 ..... A43B/7/06

* cited by examiner

*Primary Examiner*—Anthony D. Stashick
(74) *Attorney, Agent, or Firm*—Murphey & Murphey, A.P.C.

(57) ABSTRACT

A water purging system for a flexible diving boot, including a first layer of flexible material located adjacent the interior of the boot in contact with the foot of the diver. The first layer of flexible material having at least one first aperture for passing a volume of water away from a diver's foot, outward through the material. A second layer of material is located on the opposite side of the first layer from the interior of the boot. The second layer has at least one second aperture for passing a volume of water from one side of the layer to the other side of the layer. The apertures prevent an influx of water into the boot when the diver's boot is in the water. The boot allows outflow of water from the boot, when the diver exits the water and either walks about on a solid deck or places the boot in a heel-down position against a supporting surface.

3 Claims, 4 Drawing Sheets

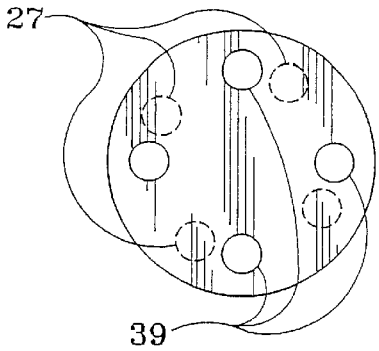
Figure 5
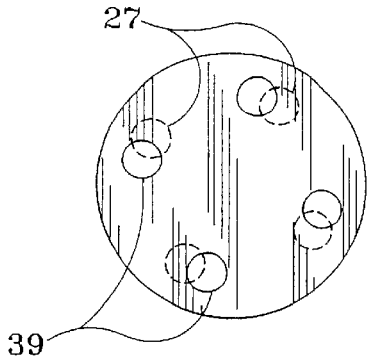
Figure 6
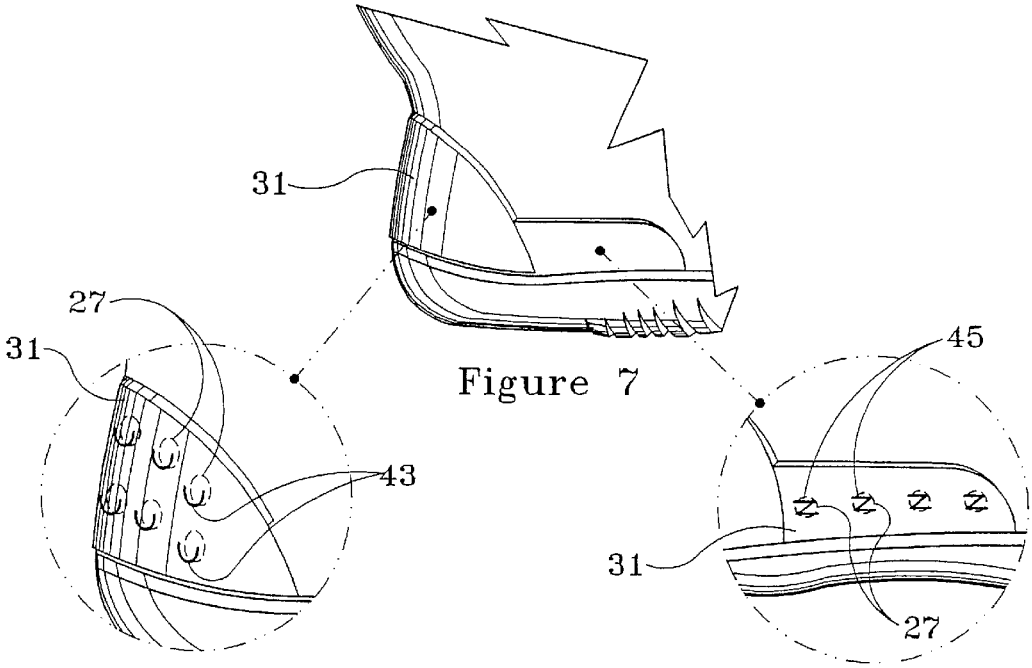
Figure 7
Figure 7a
Figure 7b
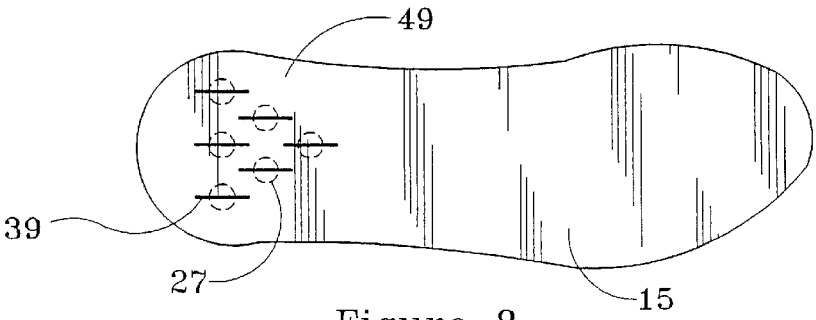
Figure 8

DIVE BOOT PURGE SYSTEM

BACKGROUND OF THE INVENTION

1. Field of the Invention

This invention relates to underwater accessories to be worn by a diver. More particularly, it pertains to a purge system for a boot, to be worn by the diver that, upon exiting the water, drains the water that infiltrated the boot during the dive.

2. Description of the Prior Art

In the field of human underwater activities, there have been many improvements in diving clothes, diving equipment and diving accessories. The clothes are being made from newer materials that help insulate the diver from the uncomfortable temperatures of deep water. The diving tanks, valves and pressure gauges have been improved to provide more reliability to make the dive safer for the diver. Other accessories, such as computers, underwater communication devices, and the like have not only improved the quality of the dive but have raised the level of safety as well.

There is, however, a continuing problem with water accumulating in the diving suit during the dive and expelling this water from the suit after emerging from the water. The very act of sealing the suit against unwanted influx of water during the dive must be tempered against not overly restricting movement of the extremities, such as one's hands and feet, so that the dive may be enjoyed rather unrestricted against movement. The flexibility of such a suit therefore mandates against a suit that is sealed too tightly. Water that enters various parts of the diving suit during the dive does not cause a problem for the diver as he or she is at neutral buoyancy during the dive.

When, however, the diver exits the water, he or she stands up and thereafter remains mostly in a vertical position, either sitting or standing. Gravity works to bring the water in the suit down to the foot area with the result that the boots become overinflated with water and balloon outward. This ballooning effect makes walking about the deck of a boat very uncomfortable, as well as dangerous, and in other respects makes the diver look rather outlandish with enlarged feet not unlike that of a duck.

The standard remedy is to take the boots off, turn them upside down and dump out the water. With more modern diving suits this is not always possible without stripping off the pants or otherwise having to unlatch or unzip other parts of the suit. Such actions may cause embarrassment when different sexes are diving together, and may otherwise cause difficulty in getting the boots back on after draining them.

SUMMARY OF THE INVENTION

This invention is a dive boot purge system that may be applied to a wide range of diving gear, especially to those diving suits with integral boots. The boots possessing the purge system of this invention need not be removed after exiting the water. By either walking about on a deck or other hard surface or placing the feet in a proper and controlled position while sitting, neither act being uncomfortable for the average diver, the system will be activated and the entire water content of the boot will be quickly and harmlessly disgorged.

Accordingly, the main object of this invention is a diver's boot purge system that rids the boot of accumulated water virtually immediately upon exiting the water yet does not allow the influx of water into the boot upon reentering the water. Other objects of the invention include a means of rapidly draining water accumulated during the dive from the boot and the lower extremities of the diving suit; a means of rapidly ridding the dive boots of water without having to remove the boots; a means of preventing water from remaining in the boot after the dive is over and having the water drain from the boot upon exiting from the water; a means of relieving the diver from the uncomfortable, unsightly and occasionally hazardous situation of bloated diving boots; and, a means of modernizing the diving boot to promote the safety and comfortableness of the sport.

These and other objects of the invention will become more clear when one reads the following specification, taken together with the drawings that are attached hereto. The scope of protection sought by the inventors may be gleaned from a fair reading of the Claims that conclude this specification.

DESCRIPTION OF THE DRAWINGS

FIG. 5 is an illustrative view of the spacing of the first and second apertures used in this invention;

FIG. 6 is the same view as FIG. 5 as the diver walls about or after resting the diving boot in a heel-down position;

FIG. 7 is a side view of a portion of the rear of the diving boot;

FIG. 7*a* is a close-up view of the U-shaped slits located at the portion of the rear of the diving boot shown in FIG. 7;

FIG. 7*b* is a close-up view of the Z-shaped slits located at the portion of the rear of the diving boot shown in FIG. 7;

FIG. 8 is a bottom view of the typical dive boot, showing the heel and sole portion thereof, using this invention wherein the first and second apertures are located under the heel portion;

DESCRIPTION OF THE PREFERRED EMBODIMENT

Figure 1:
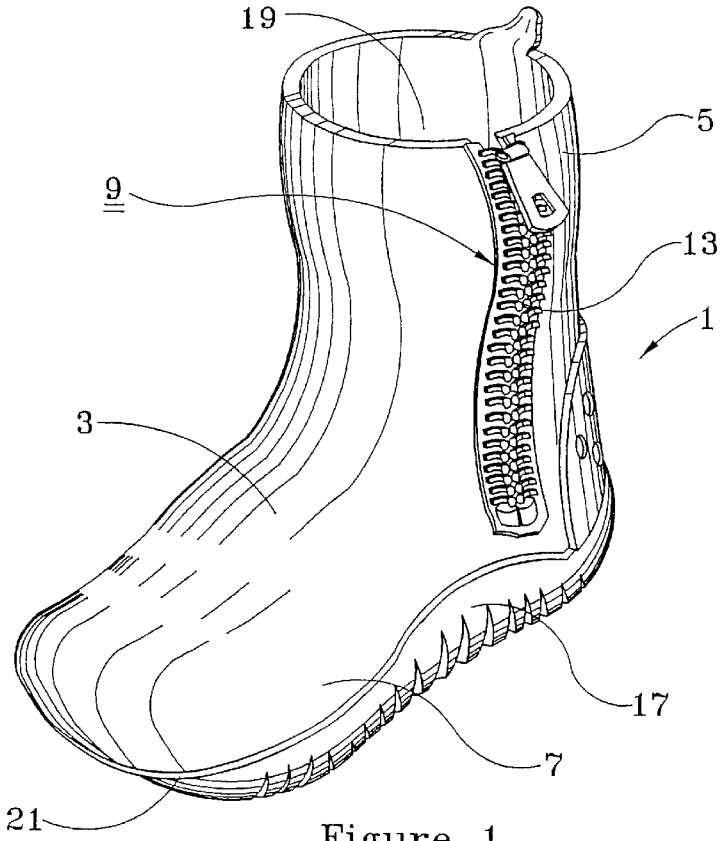
FIG. 1 is a perspective view of a typical dive boot showing the location of the preferred embodiment of this invention at the rear of the heel portion thereof.

Turning now to the drawings wherein elements are identified by numbers and like elements are identified by like numbers throughout the 12 figures, the invention is depicted in FIG. 1 and shows a water purging system 1 for a flexible diving boot, said boot comprising a thin layer 3 of flexible material, such as cloth-covered Neoprene®, surrounding the ankle region 5 and foot region 7 of the boot above the sole and heel of the wearer and means 9 for closing it about the diver's foot, such as a zipper 13, hooks and catches, or releasably attachable strips of hook and entanglement such as Velcro®. The boot further includes a sole and heel layer 15 (see FIG. 8) of similar material except that it may be made slightly thicker for supporting the user when walking on hard surfaces. Sole and heel layer 15 is defined by a perimeter 17 that is attached to thin layer 3 by glue, sewing stitches, and the like, to form the boot having a hollow interior 19, for the diver's foot. Sealing strips 21 of Neoprene® or other water-proof materials may be used to complete the construction of the boot.

Figure 2:
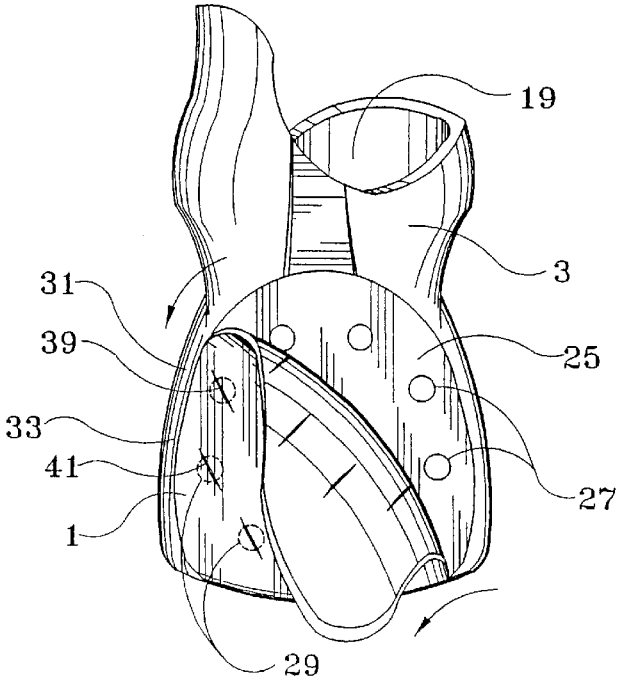
FIG. 2 is a close-up view of one embodiment of this invention showing the second layer partially pulled away to reveal the outer surface of a portion of the first layer and the apertures formed therein and the inner or under surface of a portion of the second layer and the apertures formed therein.
Figure 3:
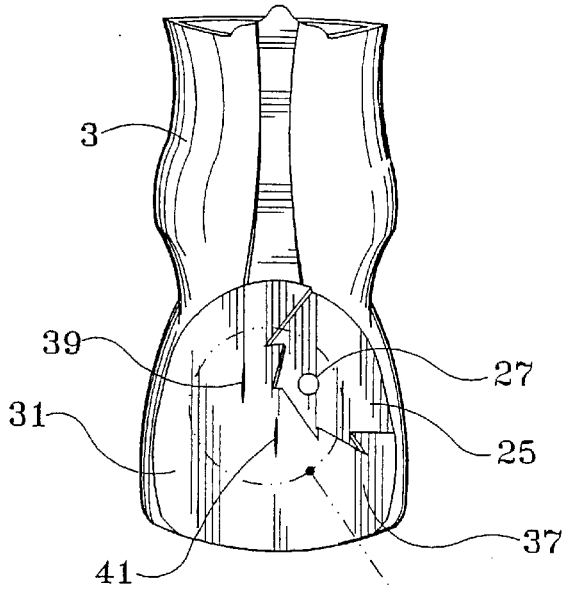
FIG. 3 is a rear view of the typical dive boot showing a partial break-away to reveal one of the first apertures formed in the first layer and two of the slits formed in the second layer.
Figure 3A:
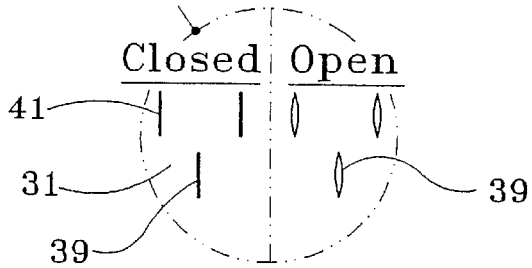
FIG. 3*a* is a view of the action of slit openings as used in this invention showing them in a closed and in an open position.

As shown in FIGS. 2, 3, and 3*a*, the preferred embodiment of the invention comprises a first layer 25 of flexible material, such as cloth-covered Neoprene®, located adjacent hollow interior 19 of boot 1 for placement in contact with the foot of the diver. First layer 25 has formed therethrough at least one, but preferably a plurality of first apertures 27, arranged in a design, such as a circle, an ellipse, a rectangle, or other formation, for draining the water 29 (see FIG. 4) from boot interior 19 outward through layer 25 in the direction of the arrows. First layer 25 is preferably the same layer that forms boot 1 while first apertures 27 a re preferably located behind the heel portion of boot 1 as shown in FIGS. 1 and 4.

A second layer 31 of flexible material is located contiguous and against first flexible layer 25 and on the outside of boot 1 or on the opposite side of first layer 25 from boot interior 19. Second layer 31 is defined by opposed, inner and outer surfaces 33 and 37 respectively, and is arranged in close, spaced-apart arrangement to preferably make second layer 31 as thin as first layer 25. This is not to say that the thicknesses of first and second flexible layers have to be the same. For certain purposes, such as the size of boot 1 and the flexibility of layers 25 and 31, the thickness of one layer may be different from the thickness of the other layer. Second layer 31 has formed therethrough at least one, but preferably a plurality of second apertures 39, arranged in a design, such as a circle, an ellipse, a rectangle, or other geometric formation, for draining water 29 from boot interior 19 outward through first and second layers 25 and 31. It is important to the function of the invention that the arrangement of first and second apertures 27 and 39 be such that they allow water to be purged from the boot when the swimmer exits the water but not allow reentry of water into the boot when the swimmer reenters the water. Accordingly, as shown in FIG. 5, first and second apertures 27 and 39 are staggered such that, during swimming when the boot in up off the sea floor, they do not align and thus prevent water from entering the boot. During heel-down resting of the boot on a solid surface and out of the water, the apertures align to allow purging of the water. As shown in FIG. 3, when first apertures 27 are formed as slits and second apertures 39 are formed as circular holes, they can be placed in alignment and they will only open when the boot is heel-down rested on a solid surface out of the water.

The invention further contemplates that first and second apertures 27 and 39 each assume a first configuration, and second layer 39 assumes a second configuration, each out of mutual axial alignment to create a torturous path therebetween, to prevent an influx of water into boot 1, as shown in FIG. 5, such as when the diver's boot is suspended underwater for diving activities. Each said first and second apertures 27 and 39 then distort into a second configuration, along wrinkle lines 41, in one or both layers as shown, and come into substantial mutual axial alignment, as shown in FIG. 6, to allow outflow of water 29 from boot 1, when the diver exits the water and either walks about or places boot 1 in a heel-down position against a supporting surface, such as the underlying floor of a boat, as shown in FIG. 4.

Figure 4:
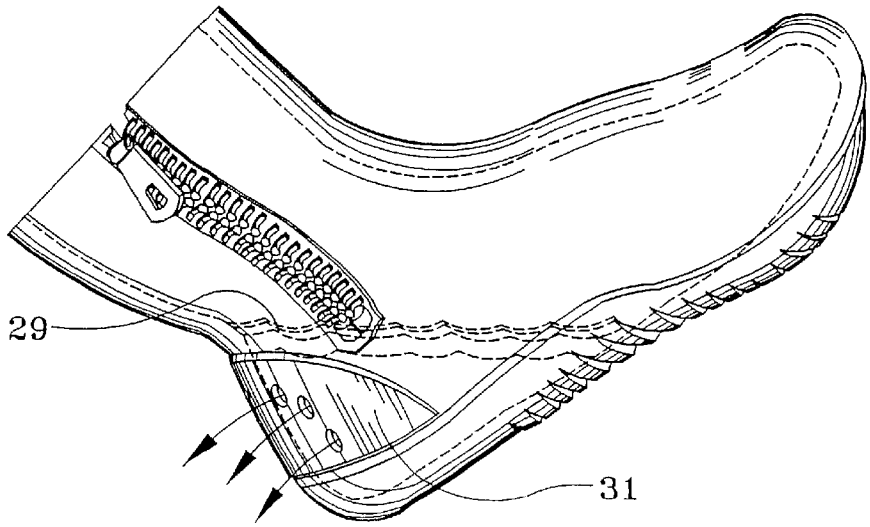
FIG. 4 is an illustrative view of the position of the diving boot in a heel-down position so that the water can drain therefrom through the purge system of this invention.

The invention contemplates that the diver will be walking about or sitting with his or her feet resting, heel-down, on some hard surface, such as the deck of a boat or a chair, as shown in FIG. 4, when the diver is out of the water to rest, to wait for another air tank for further diving, and for other reasons. During this time, the diver can easily walk or rest his or her feet and boots on a deck or other flat surface and can arrange his or her feet to rest on that surface with the heel of the foot down and the toes up. In the walking or resting arrangement, as shown in FIG. 4, second apertures 39 distort and move into axial alignment with first apertures 27 to provide a low resistance path from interior boot 1 to the exterior thereof, behind the diver's heel, to allow water remaining in boot 1 to escape to the outside of the boot and run onto the deck or other supporting surface. While walking about, the action of the foot in the boot creates some small measure of a pumping action to hasten the purging of water from boot 1. It is contemplated that, in many cases, first layer of flexible material 25 will reside adjacent the interior of boot 1 for placement directly in contact with the foot of the diver and second layer of flexible material 31 will lie to the outside of first layer 25, be in contact or contiguous thereto, and thus not create an unsightly or unwieldily attachment to boot 1. Second layer 31 may be conveniently sewn or glued or otherwise attached to the outside of boot 1, generally about its periphery, over first layer 25.

Further, first layer 25 and second layer 31 are the minimum layers contemplated herein to perform the services attributable to this invention. It is contemplated that a third layer, a fourth layer, and even more layers may be needed depending upon the structure of the individual layers and of the size and shape of boot 1. All of these designs are fully contemplated in this invention.

Depending upon the type of material making up first and second layers 25 and 31, either one or both layers of the material may not be designed as stretchable and only be flexible so that first and second apertures 27 and 39 can be forced into a distortion that aligns them and forms a low-resistance pathway between hollow interior 19 of boot 1 and the outside. In other cases, it is contemplated that first and second layers 25 and 31 will be stretchable and flexible as well. In most cases, however, both first and second layers 25 and 31 will lie contiguous and touching each other while second layer 31 will not be a part of the material making up the basic construction of boot 1. It is to be kept in mind that water is not allowed to reenter the boot when the swimmer reenters the water and their boot-clad feet are lifted off the hard sea floor in a swimming action. The dislocation of first and second apertures 27 and 39, as well as the closure of slits and other self-closing apertures provides this function to the invention.

As shown in FIG. 5, in its basic design, first apertures 27 in first layer 25 will comprise one set of apertures and second apertures 39 in second layer 31 of flexible material will also comprise only one set of apertures wherein both sets of apertures will be round holes and laterally spaced apart from each other. This configuration makes for a smooth operation of alignment of the holes while the roundness of the holes does not promote tearing and/or cracking of the flexible material around the holes during times of extreme stress such as when the diver slips and his or her foot moves sideways in the boot. The holes in apertures 27 and 39 may be spaced closer together than shown in FIG. 5, may be larger or smaller than shown, and may be of different sizes. The other configurations of first and second apertures 27 and 39, such as where the apertures are equal in number, equal in size, unequal in number and unequal in size, equal in number, size and shape, and unequal in number, size and shape are also contemplated herein.

Two configurations worthy of special mention are the use of slits, especially vertically oriented slits, as first and/or second apertures 27 and 39, as shown in FIGS. 2 and 3*a*, and the use of U-shaped slits 43 and Z-shaped slits 45, as shown in FIGS. 7*a* and 7*b*. These slits are useful because, by their vertical orientation and with the stiffness in the flexible material, they can be made to remain closed when boot 1 is suspended underwater, such as when the diver is swimming about, and then open when the diver has exited the water and walks about or rests his or her feet in a heel-down position as shown in FIG. 4. When the slits open, they provide a low resistance path for water trapped in boot 1 to flow out of the boot and away from the interior of the diving suit. U-shaped slits 43 and Z-shaped slits 45, as shown in FIGS. 7*a* and 7*b*, are likewise particularly useful as they are designed to remain closed during swimming activities and thus prevent the ingress of water into the boot when the swimmer has reentered the water. They also may be made oversize, to allow the water-purging action to take place in a shorter amount of time while, when not in use, the curvature of the slits are designed to hold the slits closed by the flexibility of the individual layer in which the slit is formed. In addition, with slits, first and second apertures may be designed to be very close to alignment or superimposed over each other. Both of these configurations are fully contemplated in this invention As shown in FIG. 8, in another preferred embodiment of the invention, the water purging system is located underneath the heel portion 49 of the boot. In this embodiment, the holes or slits are located directly beneath the heel of the boot so that, as the diver walks about the deck after emerging from the water, his or her walking creates a mild pumping action inside boot interior 19 that enhances the purging action through apertures 27 and 39. Even if the diver is not walking, as long as the foot is placed in a heel-down position on the deck, apertures 27 and 39 will distort and substantially align and provide the low resistence pathway for purging water from the boot.

Figure 9:
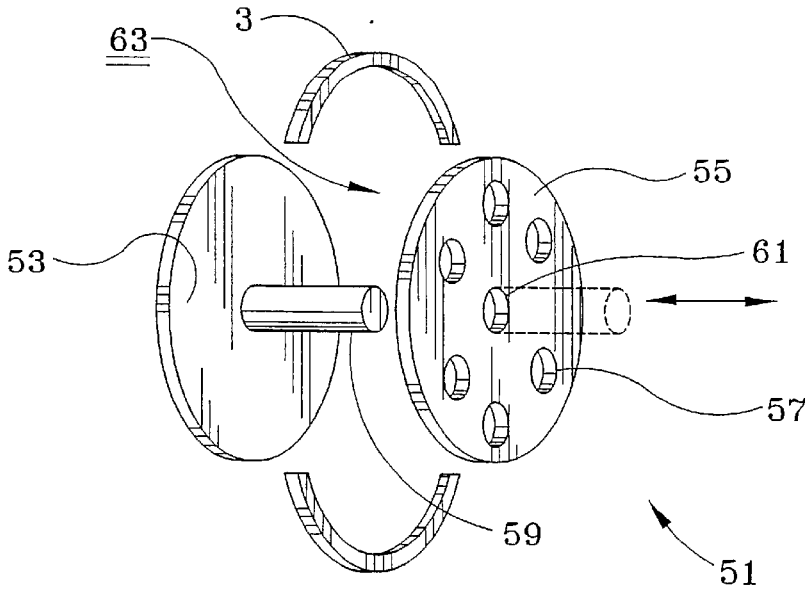
FIG. 9 is a perspective view of the self-contained purge valve useful in another embodiment of this invention.

As shown in FIG. 9, another embodiment of this invention is the placement of self-contained, purge valve means 51 behind the heel or to one side of boot 1 near perimeter 21. Purge valve means 51 may take a wide variety of forms. As shown in FIG. 9, means 51 comprises a first, soft sealing disc 53, affixed over a hole (not shown) formed in thin layer 3 of boot 1. A second, flexible, purging disc 55 is provided having a plurality of holes 57 formed therethrough and is axially positioned in full contact with layer 3 and in sealing engagement with disc 53. A stub 59 extends outward from disc 53 and through an aperture 61 formed in disc 53. Means 63, such as a spring or a rubber clip, is provided to place sealing disc 53 and purging disc 55 into biased adjacent contact on the inside surface and the outside surface respectively of thin layer 3 to prevent passage of water through the hole formed in thin layer 3, as aforesaid. Depending upon the configuration of purge valve means 51, the diver may pull stub 59 outward to temporarily part discs 53 and 55 or push stub 59 inward to accomplish the same function. In either case, once the pulling or pushing of stub 59 parts discs 53 and 55, water will flow from inside boot 1 to the outside of the boot through the hole in layer 3 and holes 57 in disc 55. This embodiment allows the swimmer to purge his or her boots on demand. The construction of this embodiment likewise prohibits the influx of water into the boot when the swimmer's foot is suspended in water such as when he or she reenters the water.

Figure 10:
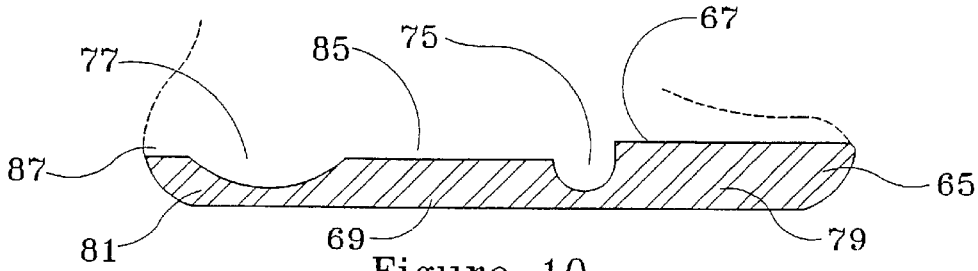
FIG. 10 is a side view of another embodiment of this invention applied to a thickened sole and heel portion of the boot.
Figure 11:
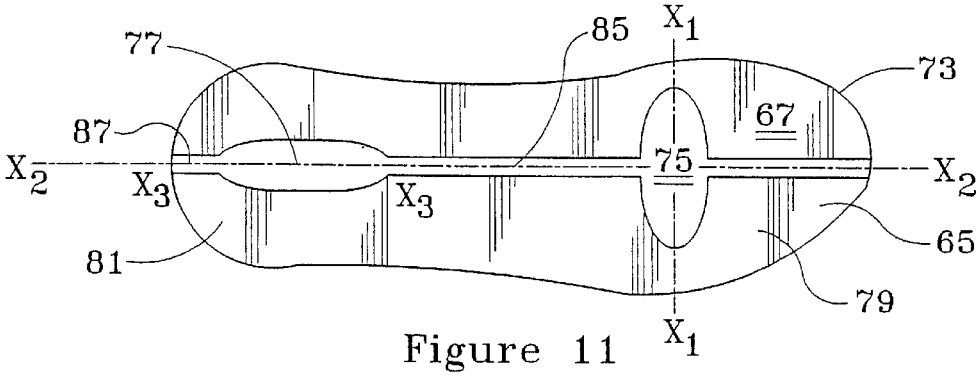
FIG. 11 is a bottom view of the embodiment shown in FIG. 10.
Figure 12:
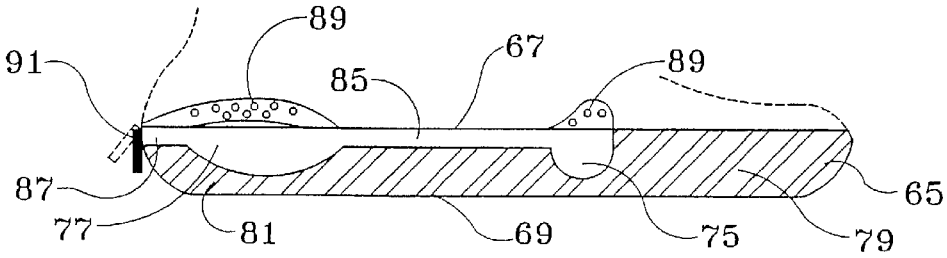
FIG. 12 is a similar view as shown in FIG. 10 with a further modification.

FIGS. 10, 11 and 12 show still other embodiments of this invention wherein boot 1 is designed slightly differently in that it includes a thicker sole and heel layer 65, defined by an upper surface 67, for adjacent contact with the sole and heel of the diver, and a lower surface 69, spaced-apart therefrom, for adjacent contact with the ocean floor or deck on which the diver walks. Thick sole and heel layer 65 is also defined by a perimeter 73 that is attached thereabout to thin layer 3 (not shown) by glue, sewing stitches, and the like to form this new embodiment of boot 1.

First and second depressions 75 and 77 are formed respectively in the sole portion 79 and the heel portion 81 of thick layer 65, that open upward from upper surface 67 and are in spaced-apart arrangement as shown in FIGS. 10, 11 and 12. Depressions 75 and 77 are joined together by a duct 85 formed in sole and heel layer 65. An aperture 87 is formed in sole and heel layer 65, aft of heel portion 81, and opens outward from the boot from which water, collected in depressions 75 and 77 during underwater activities, is expelled from the boot when the diver exits the water and either walks about the deck or places the boot in a flat or heel-down position.

In this embodiment, a layer 89 of perforated material, may be placed on or over upper surface 67 to cover upwardly-opening depressions 75 and 77 to aid in supporting the foot of the diver and in expelling water from said depressions. Layer 89 may be stiff or flexible, depending upon various factors in the construction of the purge system. Also, in this embodiment, it is preferred that first depression 75 be made elliptical in outline, as shown in FIG. 11, and arranged with its major axis, $x_1$—$x_1$, orthogonal to the main axis, $x_2$—$x_2$, passing between sole and heel portions, 79 and 81, of boot 1. Likewise, in this embodiment, it is preferred that second depression 77 be made elliptical in outline, as shown in FIG. 11, and arranged with its major axis, $x_3$—$x_3$, parallel to or superimposed upon axis, $x_2$—$x_2$, passing between sole and heel portions, 79 and 81, of the boot. In this embodiment, it is desired to hingedly mount a small flapper 91 outboard from aperture 87 that is biased in the closed position. Walking about will loosen flapper 91, as shown by the dotted outline, to allow the water in the boot to be purged therefrom while the bias of flapper 91 will prevent the ingress of water into the boot when the swimmer reenters the water.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A water purging system for a flexible diving boot, said boot comprising:

a) a thin layer of flexible material surrounding the ankle and foot region of said boot above the sole and heel of the wearer;

b) a thick sole and heel layer, having an upper surface and a lower surface, said layer positioned at the bottom of said boot and defined by a perimeter that is attached to said thin layer of flexible material;

c) first and second depressions formed respectively in the sole and the heel portion of said sole and heel layer, and opening upward from said upper surface thereof, in spaced-apart arrangement, said first and second depressions joined together by a duct formed in said sole and heel layer; and, d) an a first aperture formed in said sole and a second aperture formed in said heel layer, aft of said heel portion, and opening outward from said boot from which water, collected in said boot during underwater activities, will drain to the boot to be expelled from the boot when the diver exits the water and places the boot in a heel-down position wherein the first aperture and the second aperture are askew when situated in water and further wherein the first aperture and second aperture are aligned when the boot is in a heel-down position.

2. The water purging system for a flexible diving boot of claim 1 further including a layer of perforated material covering over top of said upwardly opening depressions to support the foot of the diver and to aid in expelling water from said depressions.

3. The water purging system for a flexible diving boot of claim 1 further including a flap, biased in a closed position over said aperture to allow purging of water from inside said boot but preventing influx of water into said boot when the boot is placed in the water.

* * * * *